US006250389B1

(12) United States Patent
Sudol

(10) Patent No.: US 6,250,389 B1
(45) Date of Patent: Jun. 26, 2001

(54) METHOD OF OIL/GAS WELL STIMULATION

(76) Inventor: Tad Sudol, 11724 - University Avenue, Edmonton, Alberta (CA), T6G 1Z5

( * ) Notice: Subject to any disclaimer, the term of this patent is extended or adjusted under 35 U.S.C. 154(b) by 0 days.

(21) Appl. No.: 09/331,677

(22) PCT Filed: Dec. 23, 1997

(86) PCT No.: PCT/CA97/00999

§ 371 Date: Jun. 23, 1999

§ 102(e) Date: Jun. 23, 1999

(87) PCT Pub. No.: WO98/28519

PCT Pub. Date: Jul. 2, 1998

(30) Foreign Application Priority Data

Dec. 24, 1996 (CA) ..... 2193923

(51) Int. Cl.[7] ..... E21B 21/00; E21B 43/25; E21B 37/00

(52) U.S. Cl. ..... 166/312; 166/222

(58) Field of Search ..... 166/311, 312, 166/56, 105, 106, 222, 223, 68, 372

(56) References Cited

U.S. PATENT DOCUMENTS

| | | | | |
|---|---|---|---|---|
| 2,290,141 | | 7/1942 | Burt . | |
| 4,183,722 | * | 1/1980 | Roeder | 417/172 |
| 4,658,893 | * | 4/1987 | Black | 166/68 |
| 4,671,359 | * | 6/1987 | Renfro | 166/312 |
| 4,744,420 | | 5/1988 | Patterson et al. | 166/312 |
| 4,919,204 | * | 4/1990 | Baker et al. | 166/223 |
| 5,033,545 | | 7/1991 | Sudol | 166/312 |
| 5,086,842 | | 2/1992 | Cholet | 166/312 |
| 5,280,825 | | 1/1994 | Cholet | 166/311 |
| 5,318,128 | | 6/1994 | Johnson et al. | 166/312 |
| 5,374,163 | * | 12/1994 | Jaikaran | 417/172 |

OTHER PUBLICATIONS

Drilling Damage Removal Using Multi–point Drawdowns along the Horizontal Wellbore, B.K. Heikkinen, M.P. Kuchel, Q.S. Stang, J.G. Misselbrook, T.A. Sudol and D.A. Lillico, SPE 46011, Society of Petroleum Engineers, prepared for presentation at the 1998 SPE/IcoTA Coiled Tubing Roundtable held in Houston, Texas, Apr. 15–16, 1998, 6 pages.

New Laboratory Procedures for Evaluation of Drilling Induced Formation Damge and Horizontal Well Performance: An Update, K.L. Adair, N.G. Gruber, SPE 37139, Society of Petroleum Engineers, prepared for presentation at the 1996 SPE International Conference on Horizontal Well Technology held in Calgary, Canada, Nov. 18 –20, 1996, p. 841 –851.

* cited by examiner

*Primary Examiner*—David Bagnell
*Assistant Examiner*—Jennifer R. Dougherty
(74) *Attorney, Agent, or Firm*—Christensen O'Connor Johnson Kindness PLLC

(57) ABSTRACT

A method of oil/gas well stimulation. Firstly, positioning a venturi-style pumping apparatus (12) in a wellbore (14) within a selected production zone (16) of an oil/gas producing formation (18). The pumping apparatus (12) is connected to a first conduit (21) and a second conduit (25). Secondly, activating the pumping apparatus (12) to induce a flushing of fluids and contaminants from the oil/gas producing formation (18) into the wellbore (14). Thirdly, pumping power fluid that powers the pumping apparatus (12) via the first conduit (21) and directing a portion of the power fluid through at least one fluidizing nozzle (15) to sufficiently fluidize contaminants to enable the contaminants to be removed from the wellbore (14) along with pumped fluids by the pumping apparatus (12) via the second conduit (25).

35 Claims, 2 Drawing Sheets

METHOD OF OIL/GAS WELL STIMULATION

FIELD OF THE INVENTION

The present invention relates to a method of oil or gas well stimulation.

BACKGROUND OF THE INVENTION

When an oil well is drilled, drilling fluids are pumped downhole. The drilling fluids serve several purposes. One purpose is to lubricate the drill bit. Another purpose is to carry cutting from away from the drill bit. Yet another purpose is to control pressure within the wellbore.

Papers have documented that these drilling fluids damage the formation by adversely effecting its relative permeability. At an annual technical meeting of the Petroleum Society of CIM in Calgary, May 9–12, 1993 one such paper, paper no. CIM 93-24, was presented entitled "Reductions in the Productivity of Oil and Gas Reservoirs due to Aqueous Phase Trapping". This paper outlines mechanisms leading to aqueous phase trapping which are caused by the introduction of fluids into the well.

The recognition of this problem has lead to various methods being developed to stimulate oil or gas wells. These methods are used to stimulate a well prior to it being put into production or when production is falling below levels that make the recovery of the oil or gas commercially viable. The most common method of stimulating a well prior to it being put into production is acidizing a well through the use of a "stimulation fluid". U.S. Pat. No. 5,152,907 which issued to Amoco Corporation in 1992 entitled "Solvent Systems for Use in Oil and Gas Wells" provides background relating to the composition of such stimulation fluids. It should be noted, however, that Paper no. CIM 93-24, lists among the fluids that cause formation damage through aqueous phase trapping, stimulation fluids (including spent acid).

There are various forms of venturi-style pumping apparatus that are presently used for cleaning sand from horizontal sections of unconsolidated reservoirs or pumping from vertical sections of said reservoirs. One example of such a pumping apparatus is U.S. Pat. No. 5,033,545 which issued to Sudol in 1991.

SUMMARY OF THE INVENTION

The present invention relates to a method of utilizing a venturi-style pumping apparatus in a new and unobvious manner to stimulate an oil or gas well.

According to the present invention there is provided a method of oil/gas well stimulation. Firstly, positioning a venturi-style pumping apparatus in a wellbore within a selected production zone of an oil/gas producing formation. The pumping apparatus is connected to a first conduit and a second conduit. Secondly, activating the pumping apparatus to induce a flushing of fluids and contaminants from the oil/gas producing formation into the wellbore. Thirdly, pumping power fluid that powers the pumping apparatus via the first conduit and directing a portion of the power fluid through at least one fluidizing nozzle to sufficiently fluidize contaminants to enable the contaminants to be removed from the wellbore along with pumped fluids by the pumping apparatus via the second conduit.

With the method, as described above, the flushing of drilling fluids and other contaminants from the formation is induced by the creation of a pressure differential. This method is more effective and prevents residual detrimental effects being sustained by the formation as a result of the use of stimulation fluids.

It is preferred that concentric tubing being provided. The power fluid is transported through an inner tube which serves as the first conduit. The pumped fluids are transported through an annulus formed between the inner tube and an outer tube which serves as the second conduit.

A major advantage of the method, as described above, is its ability to treat wellbores that have been completed with slotted tubular liners or perforated pipe. There are a number of variations of slotted liners and perforated pipe presently in use. These include slotted liners and perforated pipe that have been wrapped with a wire, screen, steel wool, and the like. One of the purposes of the slotted liners or perforated pipe is to limit the incursion of particulate contaminants into the wellbore. It is, of course, preferable to induce a flushing of the formation after the slotted liner or perforated pipe is in place so as to limit the incursion of particulate contaminants into the wellbore. Furthermore, once the slotted liners or perforated pipe has been in place for a period of time rust and mill scale develops. This rust and mill scale becomes one of the contaminants that restrict the production of the well. The method, as described above, provides a method of treating the well for rust and mill scale contamination at the same time as formation stimulations is occurring.

The power fluid is selected to be compatible with the formation. Depending upon the dominant fluid in the formation, the power fluid may be either water based or hydrocarbon based. Additives can be included in the power fluid to enhance fluidization of contaminants. Depending upon the nature of the contaminants, the dominant fluid in the formation and the nature of the formation, the additives may include surfactants, gas, or scaling agents. The power fluid may be heated where viscosity of liquids in the formation is of concern of where it may enhance stimulation.

In some cases the production zone has a considerable length. This is common with horizontal well completions. Where the production zone has such a length it is preferred that the additional step be taken of moving the pumping apparatus slowly along the wellbore in a traverse of the selected production zone.

The concentric tubing can pose a handling problem. It is, therefore, preferred that the concentric tubing be unwound from a coil as it is inserted into the wellbore. Similarly, the concentric tubing is wound back onto the coil as it is withdrawn.

The preferred method of fluidizing the contaminants is to place at least one fluidizing nozzle on the body of the pumping apparatus. With wells that have not been completed using slotted liners or perforated pipe, one can expect that some particulate matter is going to be drawn into the wellbore during treatment. In such cases, it is preferred that there be at least one forwardly directed fluidizing nozzle and at least one rearwardly directed fluidizing nozzle. The provisions of such nozzles ensure that the particulate contaminants are sufficiently fluidized to avoid having the pumping apparatus become stuck as it goes in and as it comes out of the wellbore. A valve is preferably provided for switching the fluidizing nozzles on and off. The valve may also have provision to allow switching between the at least one forwardly directed fluidizing nozzle and at least one rearwardly directed fluidizing nozzle.

It is preferred that the monitoring of certain parameters be included when practising the method. There are a number of further steps that can be included, depending upon the results that are desired. The further step of monitoring the flow rate of pumped fluids and determining the flow rate of fluids from the formation by subtracting from the flow rate of pumped fluids the flow rate of power fluid. The further step of sensing pressure in the wellbore while pumping. The further step of sensing temperature in the wellbore while pumping. The further step of monitoring the relative fractions of oil/water/gas/solids present in the pumped fluids. For example, if one key parameter is selected such as pressure; pressure sensing means can be placed into the wellbore along with the pumping apparatus. This enables an evaluation to be made of formation inflow capabilities. The pumping apparatus can then be operated at as low a pressure as the influx of fluids and contaminants during pumping will allow.

To enhance the stimulation effect or to address cases in which the incursion of particulate matter or the inflow of water from particular zones is a problem, it is preferred that a further step be taken of positioning sealing means, such as a packer, in the wellbore to hinder the movement of fluids and solids. This enables selected stimulation to be achieved, without drawing water from a water zone or sand from a sand zone.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

The preferred method of oil/gas well stimulation will now be described with reference to FIGS. 1 and 2.

Figure 1:
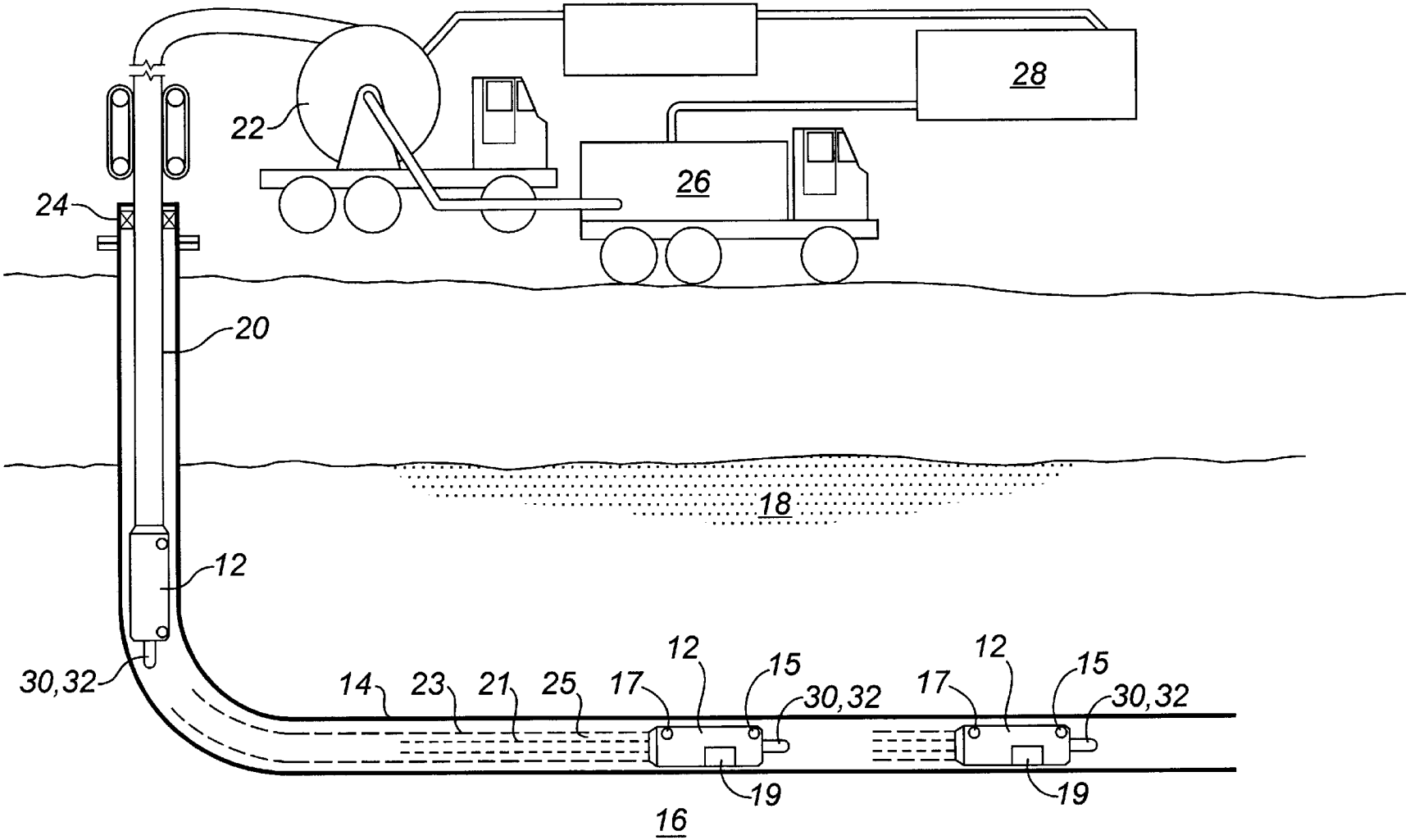
FIG. 1 is a side elevation view illustrating a method of oil/gas well stimulation in an unlined horizontal well in accordance with the teachings of the present invention.

FIG. 1 illustrates stimulation of an unlined horizontal well. Firstly, position a venturi-style jet pumping apparatus 12 in a wellbore 14 within a selected production zone 16 of an oil/gas producing formation 18. There are various venturi-style pumping apparatus known in the art. The particular pumping apparatus utilized by the Applicant is described in U.S. Pat. No. 5,033,545. It is preferred that pumping apparatus 12 have one or more forwardly directed fluidizing nozzles 15 and one or more rearwardly directed fluidizing nozzles 17. A pressure sensitive switching valve 19 is preferably provided to permit switching of nozzles 15 and 17 on and off. Valve 19 may also make provision for switching between forward nozzles 15 and rearward nozzles 17 by varying the pressure of the power fluid. Pumping apparatus 12 is connected to a first conduit and a second conduit. It is preferred that venturi-style pumping apparatus 12 be used with concentric coil tubing 20. Concentric coil tubing 20 is transported on a truck mounted coil or reel 22. Concentric coil tubing 20 has an inner tube 21 and an outer tube 23. Inner tube 21 serves as the first conduit. An annulus 25 formed between inner tube 21 and outer tube 23 serves as the second conduit. An upper packer assembly 24 is positioned between concentric coil tubing 20 and wellbore 14. A pump truck 26 is used to supply a pumping force, as required. The power fluid used with venturi-style pumping apparatus 12 is held in a tank 28 connected to pump truck 26.

Secondly, activating venturi-style pumping apparatus 12 to artificially lower the pressure in wellbore 14 until an underbalanced condition is created in which pressure in the oil/gas producing formation 18 is greater than pressure within wellbore 14. This induces a flushing of fluids from oil/gas producing formation 18 into wellbore 14; the rate of which depends upon the permeability of the formation and the amount of the pressure differential.

Thirdly, pumping power fluid into wellbore 14 via inner tube 21 which serves as the first conduit and directing a portion of the power fluid through fluidizing nozzles 15 and/or 17 to sufficiently fluidize contaminants to enable the contaminants to be removed from wellbore 14 along with pumped fluids by pumping apparatus 12 via annulus 25 which serves as the second conduit.

Venturi-style pumping apparatus 12 is equipped with an electronics package 30, containing a plurality of sensors 32. It is contemplated that the various operating parameters sensed would include pressure in the wellbore, temperature changes in the wellbore, and the relative percentage of oil/water/gas present in the fluids entering the wellbore. The flow rates of fluids from the formation while pumping can be obtained by mathematical calculation. The flow rate of pumped fluids is monitored, as is the flow rate of power fluid. The flow rate of fluids into from the formation is then calculated by subtracting from the flow rate of pumped fluids, the flow rate of power fluid. It is intended that pumping apparatus 12 be operated at as low a pressure as the influx of fluids and contaminants during pumping will allow. The sensing of pressure through sensors 32 assists in determining when that condition has been achieved.

A fourth step which is preferred where production zone 16 is of a substantial length is moving venturi-style pumping apparatus 12 slowly along wellbore 14 in stages, in order to traverse the selected production zone 16. This movement results in both a flushing of the entire production zone, but also of a profile of the formation being developed through the use of the sensors.

Figure 2:
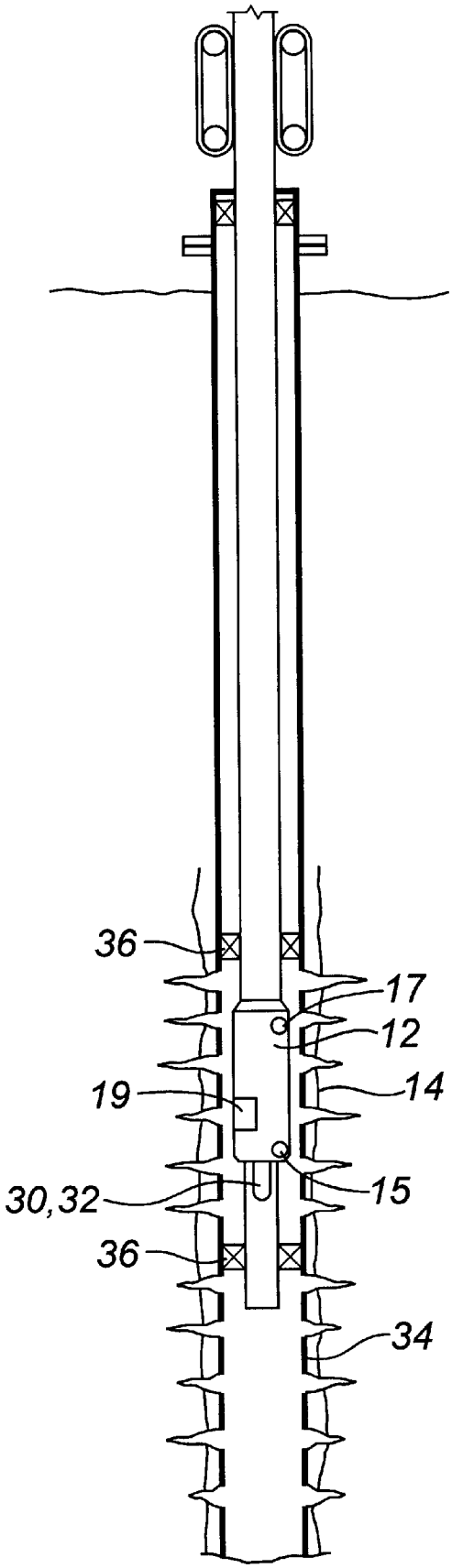
FIG. 2 is a side elevation view illustrating a method of oil/gas well stimulation in a lined vertical well in accordance with the teachings of the present invention.

FIG. 2 illustrates a lined vertical well. The environment of wellbore 14 in FIG. 2 differs due to the presence of a perforated pipe 34. Depending upon the manner of completion, the wellbore may be lined with a slotted liner as an alternative. Slotted liners can take a number of forms. Generally, efforts are made to make the slot widths as narrow as may be required to keep out particulate contaminants while maintaining acceptable flow rates. The method steps in the well configuration illustrated in FIG. 2, parallel those previously described in relation to FIG. 1. The flushing of the formation is induced, however, after perforated pipe 34 (or slotted liner) is in place, so as to limit the incursion of particulate contaminants into the wellbore. Where perforated pipe 34 (or slotted liner) has been in place for a period of time, rust and mill scale becomes one of the contaminants that restrict the production of the well. The method treats the well for rust and mill scale contamination at the same time as formation stimulation is occurring.

Sealing means, such as packers 36 maybe positioned in wellbore 14 to hinder the movement of fluids and solids. FIG. 2 illustrates a manner in which packers 36 would be positioned, assuming there exists a water producing zone which is not to be stimulated and for which isolation during well stimulation is desired.

The power fluid selected must be compatible with the formation. Depending upon the dominant fluid in the formation, the power fluid may be either water based or hydrocarbon based. Additives can be included in the power fluid to enhance fluidization of contaminants. Depending upon the nature of the contaminants, the dominant fluid in the formation and the nature of the formation, the additives may include surfactants or gas. The gas is injected into the second conduit to provide gas lift to the liquid being pumped to the surface via the second conduit. Where the contaminants include rust or mill scale, the additives may include scaling agents. The power fluid may be heated where viscosity of liquids in the formation is of concern of where it may enhance well stimulation.

It will be apparent to one skilled in the art that the method described effectively induces a flushing of drilling fluids and other contaminants from the formation by creating a pressure differential. It will also be apparent that this avoids the residual detrimental effects sustained by the formation as a result of the use of stimulation fluids. It will finally be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A method of oil/gas well stimulation, comprising the steps of:

firstly, positioning a venturi-style pumping apparatus (12), having at least one fluidizing nozzle (15 or 17) and means for switching the at least one fluidizing nozzle on and off, in a wellbore (14) within a selected production zone (16) of an oil/gas producing formation (18), the pumping apparatus (12) being connected to a first conduit (21) and a second conduit (25);

secondly, activating the pumping apparatus (12) to induce a flushing of fluids and contaminants from the oil/gas producing formation (18) into the wellbore (14); and thirdly, pumping power fluid that powers the pumping apparatus (12) via the first conduit (21) and directing a portion of the power fluid through the at least one fluidizing nozzle (15 or 17) to sufficiently fluidize contaminants to enable the contaminants to be removed from the wellbore (14) along with pumped fluids by the pumping apparatus (12) via the second conduit (25); and fourthly, shutting off the at least one fluidizing nozzle (15 or 17) in situ while continuing to pump power fluid that powers the pumping apparatus (12) via the first conduit (21 or 25) and removing pumped fluids pumped by pumping apparatus (12) via the second conduit (25 or 21).

2. The method as defined in claim 1, the contaminants being at least one of wax and asphaltine precipitated from produced fluids.

3. The method as defined in claim 1, concentric tubing being provided, the power fluid being transported through an inner tube (21) which serves as the first conduit, and the pumped fluids being transported through an annulus (25) formed between the inner tube (21) and an outer tube (23) which serves as the second conduit.

4. The method as defined in claim 1, concentric tubing being provided, the pumped fluids being transported through an inner tube (21) which serves as the second conduit, and the power fluid being transported through an annulus (25) formed between the inner tube (21) and an outer tube (23) which serves as the first conduit.

5. The method as defined in claims 3 and 4, the concentric tubing (20) being unwound from a coil (22) as it is inserted into the wellbore (14).

6. The method as defined in claim 1, the power fluid being water based.

7. The method as defined in claim 1, the power fluid being hydrocarbon based.

8. The method as defined in claim 6 or 7, the power fluid including additives that enhance fluidization of contaminants.

9. The method as defined in claim 8, the additives including surfactants.

10. The method as defined in claim 8, the additives including gas.

11. The method as defined in claim 10, the gas being injected into the second conduit to provide gas lift to the liquids being pumped to the surface via the second conduit.

12. The method as defined in claim 8, the additives including scaling agents.

13. The method as defined in claims 6 or 7, the power fluid being heated.

14. The method as defined in claim 1, including the further step of moving the pumping apparatus (12) slowly along the wellbore (14) in a traverse of the selected production zone (16).

15. The method as defined in claim 1, the wellbore (14) containing one of a slotted tubular liner (34) and a perforated pipe (34).

16. The method as defined in claim 1, the at least one fluidizing nozzle (15 or 17) being affixed to the body of the pumping apparatus (12).

17. The method as defined in claim 16, having at least one forwardly directed fluidizing nozzle (15) and at least one rearwardly directed fluidizing nozzle (17).

18. The method as defined in claim 17, including valve means (19) for switching between the at least one forwardly directed fluidizing nozzle (15) and the at least one rearwardly directed fluidizing nozzle (17).

19. The method as defined in claim 1, including the further step of monitoring the flow rate of pumped fluids and determining the flow rate of fluids from the formation (18) by subtracting from the flow rate of pumped fluids the flow rate of power fluid.

20. The method as defined in claim 1, including the further step of sensing (32) pressure in the wellbore (14).

21. The method as defined in claim 1, including the further step of sensing (32) temperature in the wellbore (14).

22. The method as defined in claim 1, including the further step of monitoring the relative fractions of oil/water/gas/solids present in the pumped fluids.

23. The method as defined in claim 1, including the further step of positioning sealing means (36) in the wellbore (14) to hinder the movement of fluids and solids.

24. The method as defined in claim 1, the contaminants being drilling fluids introduced into the formation (18) during drilling.

25. The method as defined in claim 1, the oil/gas producing formation (18) being completed with one of a slotted tubular liner (34), a perforated pipe (34), a screen (34) or a combination of the same.

26. The method as defined in claim 25, the contaminants including rust and mill scale from said one of the slotted tubular liner (34), the perforated pipe, the screen or the combination of the same.

27. The method as defined in claim 1, including the step of moving the pumping apparatus (12) slowly along the wellbore (14) in stages, thereby traversing the selected production zone (16).

28. A method of oil/gas well stimulation, comprising the steps of:

firstly, positioning a venturi-style pumping apparatus (12), having several fluidizing nozzles and means for selectively turning at least one of the several fluidizing nozzles on and off, in a wellbore (14) within a selected production zone (16) of an oil/gas producing formation (18), the pumping apparatus (12) being connected to a first conduit (21) and a second conduit (25) secondly activating the pumping apparatus (12) to induce a flushing of fluids and contaminants from the oil/gas producing formation (18) into the wellbore (14); and thirdly, pumping power fluid that powers the pumping apparatus (12) via the first conduit (21) and directing a portion of the power fluid through the several fluidizing nozzles (15 and 17) to sufficiently fluidize contaminants to enable the contaminants to be removed from the wellbore (14) along with pumped fluids by the pumping apparatus (12) via the second conduit (25);

fourth, shutting off at least one of the several fluidizing nozzles (15 or 17) in situ while continuing to pump power fluid that powers the pumping apparatus (12) via the first conduit (21 or 25) and removing pumped fluids pumped by pumping apparatus (12) via the second conduit (25 or 21).

29. A method of oil/gas well stimulation, comprising the steps of:

positioning a venturi-style pumping apparatus (12), having at least one fluidizing nozzle (15 or 17) and means for switching the at least one fluidizing nozzle on and off, in a wellbore (14) within a selected production zone (16) of an oil/gas producing formation (18), the pumping apparatus (12) being connected to a first conduit (21 ) and a second conduit (25);

activating the pumping apparatus (12);

pumping power fluid that powers the pumping apparatus (12) via the first conduit (21) and removing fluids via the second conduit (25); and injecting gas into the second conduit to provide gas lift to fluids being pumped to surface via the second conduit, while switching the at least one fluidizing nozzle on and off as required to facilitate the gas lift.

30. A method of oil/gas well stimulation, comprising the steps of:

positioning a venturi-style pumping apparatus (12), having several fluidizing nozzles (15 and 17) including at least one forward fluidizing nozzle (15), at least one rearward fluidizing nozzle (17) and means for selectively switching at least one of the several fluidizing nozzles on and off, in a wellbore (14) within a selected production zone (16) of an oil/gas producing formation (18), the pumping apparatus (12) being connected to a first conduit (21) and a second conduit (25);

activating the pumping apparatus (12);

pumping power fluid that powers the pumping apparatus (12) via the first conduit (21) and removing fluids via the second conduit (25); and directing a portion of the power fluid through the at least one forward fluidizing nozzle (15) and the at least one rearward fluidizing nozzle (17) while switching the at least one forward fluidizing nozzle (15) and the at least one rearward fluidizing nozzle (17) on and off as required to facilitate pumping.

31. A method of oil/gas well stimulation, comprising the steps of:

positioning a venturi-style pumping apparatus (12) having several fluidizing nozzles (15 and 17) including at least one forward fluidizing nozzle (15), at least one rearward fluidizing nozzle (17), means for selectively switching at least one of the several fluidizing nozzles on and off, and means for switching between the at least one forward fluidizing nozzle (15) and the at least one rearward fluidizing nozzle (17), in a wellbore (14) within a selected production zone (16) of an oil/gas producing formation (18), the pumping apparatus (12) being connected to a first conduit (21) and a second conduit (25);

activating the pumping apparatus (12);

pumping power fluid that powers the pumping apparatus (12) via the first conduit (21) and removing fluids via the second conduit (25); and directing power fluid through the at least one forward fluidizing nozzle (15) and the at least one rearward fluidizing nozzle (17) while switching the at least one of the several fluidizing nozzles (15 and/or 17) on and off as required to facilitate pumping, and switching between the at least one forward fluidizing nozzle (15) and at least one rearward fluidizing nozzle (17) to facilitate movement.

32. A method of oil/gas well stimulation, comprising the steps of:

positioning a venturi-style pumping apparatus (12), having at least one fluidizing nozzle (15 or 17) and means for switching the at least one fluidizing nozzle on and off, in a wellbore (14) within a selected production zone (16) of an oil/gas producing formation (18), the pumping apparatus (12) being connected to a first conduit (21) and a second conduit (25);

activating the pumping apparatus (12);

pumping power fluid that powers the pumping apparatus (12) via the first conduit (21) and removing fluids via the second conduit (25); and switching the at least one fluidizing nozzle on and off as required to facilitate pumping while monitoring the flow rate of pumped fluids and determining the flow rate of fluids from the formation (18) by subtracting from the flow rate of pumped fluids the flow rate of power fluid.

33. A method of oil/gas well stimulation, comprising the steps of:

positioning a venturi-style pumping apparatus (12), having at least one fluidizing nozzle (15 or 17) and means for switching the at least one fluidizing nozzle on and off, in a wellbore (14) within a selected production zone (16) of an oil/gas producing formation (18), the pumping apparatus (12) being connected to a first conduit (21) and a second conduit (25);

activating the pumping apparatus (12);

pumping power fluid that powers the pumping apparatus (12) via the first conduit (21) and removing fluids via the second conduit (25); and switching the at least one fluidizing nozzle on and off as required to facilitate pumping while monitoring (32) pressure in the wellbore (14) to evaluate wellbore response.

34. A method of oil/gas well stimulation, comprising the steps of:

positioning a venturi-style pumping apparatus (12), having at least one fluidizing nozzle (15 or 17) and means for switching the at least one fluidizing nozzle on and off, in a wellbore (14) within a selected production zone (16) of an oil/gas producing formation (18), the pumping apparatus (12) being connected to a first conduit (21) and a second conduit (25);

activating the pumping apparatus (12);

pumping power fluid that powers the pumping apparatus (12) via the first conduit (21) and removing fluids via the second conduit (25); and switching the at least one fluidizing nozzle on and off as required to facilitate pumping while monitoring (32) temperature in the wellbore (14) to evaluate wellbore response.

35. A method of oil/gas well stimulation, comprising the steps of:

positioning a venturi-style pumping apparatus (12) in a wellbore (14) within a selected production zone (16) of an oil/gas producing formation (18), the pumping apparatus (12) being connected to a first conduit (21) and a second conduit (25);

activating the pumping apparatus (12);

pumping power fluid that powers the pumping apparatus (12) via the first conduit (21) and removing fluids via the second conduit (25); and switching the at least one fluidizing nozzle on and off as required to facilitate pumping while monitoring the relative fractions of oil/water/gas/solids present in the pumped fluids.

* * * * *

UNITED STATES PATENT AND TRADEMARK OFFICE

CERTIFICATE OF CORRECTION

PATENT NO. : 6,250,389 B1
DATED : June 26, 2001
INVENTOR(S) : T. Sudol

It is certified that error appears in the above-identified patent and that said Letters Patent is hereby corrected as shown below:

Column 5,
Line 32, begin a new subparagraph with the clause -- thirdly, pumping power fluid --

Column 6,
Line 40, "(14)." should read -- (14) while pumping. --

Column 7,
Lines 3-4, begin a new subparagraph with the clause -- secondly activating the pumping apparatus --
Line 14, "fourth" should read -- fourthly --

Signed and Sealed this

Twenty-sixth Day of February, 2002

*Attest:*

*Attesting Officer*

JAMES E. ROGAN
*Director of the United States Patent and Trademark Office*